United States Patent [19]

Shaw

[11] 4,415,062

[45] Nov. 15, 1983

[54] LADDER FOOT

[75] Inventor: Jonathan L. Shaw, Clinton Township, Hunterdon County, N.J.

[73] Assignee: Western Electric Company, Incorporated, New York, N.Y.

[21] Appl. No.: 427,212

[22] Filed: Sep. 29, 1982

[51] Int. Cl.[3] ..... E06C 7/44; E06C 7/46

[52] U.S. Cl. ..... 182/109; 182/111

[58] Field of Search ..... 182/107, 108, 109, 111

[56] References Cited

U.S. PATENT DOCUMENTS

| | | | |
|---|---|---|---|
| 1,973,226 | 9/1934 | Rose | 182/109 |
| 2,309,484 | 1/1943 | Van Meter | 182/109 |
| 2,691,479 | 10/1954 | Sharp | 182/109 |
| 2,767,898 | 10/1956 | Cramer | 182/109 |
| 3,858,684 | 1/1975 | Goings | 182/111 |

*Primary Examiner*—Reinaldo P. Machado
*Attorney, Agent, or Firm*—R. F. Kip, Jr.

[57] ABSTRACT

A ladder foot (20) comprises (a) a bracket means (25) attachable at its upper end to a ladder rail (11) and including a stud (35) extending downward from such end, (b) a shoe (60) including a central sole plate (61) and a pair of upper plates (62, 63) extending from the sole plate to straddle opposite sides of the bracket means, and (c) a pin (75) fixedly secured with the upper plates and passing from one to the other through the bracket means adjacent the front side of the stud. The downward extent of the stud includes an upper range within which the stud fits between the pin and sole plate in such manner that the shoe is locked in toe-down position. Such extent also includes a lower range for which, if the pin is moved to register therein, the shoe is angularly adjustable from its toe-down position through a range of angular positions including a flat position. Integrally joined with the stud at its upper and lower ends are portions (45, 50) serving as stops for the pin, such portions cooperating with the pin to form a partial slot having a gap in its perimeter on the side of the slot away from the stud.

11 Claims, 8 Drawing Figures

LADDER FOOT

TECHNICAL FIELD

This invention relates generally to the art of ladders. More particularly, this invention relates to a ladder foot adapted when secured to the bottom of a ladder rail to be selectively adjusted so as to compensate for variations in the characteristics of the lower support surface of the ladder.

BACKGROUND OF THE INVENTION

A ladder foot commonly comprises a U-shaped shoe pivotally coupled by a pin to the bottom of a rail of a ladder in a manner whereby the shoe is angularly adjustable between flat, toe-down and intermediate positions. In the flat position, the bottom of the shoe rests on the ground or other footing to provide maximum adhesion to smooth, flat, surfaces such as asphalt, wood, concrete, etc. In the toe-down position, the shoe is tilted to have its front part contact the ground and serve as a pick like device to provide maximum penetration and thereby holding power on ice or hard, soft, sandy, or frozen earth.

In the past, it has been a common practice for the shoe of a ladder foot to be coupled to a rail of the ladder by a pin-and-slot coupling wherein the pin is passed laterally through a hole in the rail to be translationally fixed in relation thereto, and wherein the pin has opposite ends projecting out from laterally opposite sides of the ladder rail, and those opposite ends of the pin are received in two slots respectively formed in the two sidewalls of the U-shaped shoe. A ladder foot with such kind of coupling is shown, for example, in U.S. Pat. No. 2,691,479 issued Oct. 12, 1954 in the name of J. E. Sharp.

A ladder foot of such construction has, however, a number of disadvantages for use in present day ladders including, without restriction, the following.

To provide ladders which are inexpensive, light in weight and durable, the rails thereof are at present often in the form of lengths of fiberglass of U-shape in cross section so as to have a central, longitudinal elongated relatively thin web and, also, two longitudinally elongated side flanges projecting out in the same direction from the opposite sides of the web. Such rails do not lend themselves readily to a pin-and-slot coupling of a shoe to the rail wherein the two slots are in the shoe and the pin passes through a hole in the web of the rail to be translationally fixed in relation thereto. That is so, because, in view of the thinness of the fiberglass web, it would be difficult to maintain the bolt fixed in its normal alignment to the web and, because in view of such web thinness and the lack of mechanical strength of the fiberglass web (as compared to, say, the metal web of an aluminum rail or the solid thickness of a wooden rail), the transmission of half the weight of the ladder and its occupant from the web to the pin would create undue stresses in the region of the web near the pin.

As another consideration, the provision of pivotally mounting the shoe to the ladder rail by a pin-and-slot coupling wherein slots are formed in the sidewalls of the shoe has the disadvantage that the slots take up substantial space in the shoe's sidewalls in which formed, and such slots must, of course, each be surrounded by sufficient thickness of sidewall material throughout the length of the slot to withstand the mechanical strain imposed on each sidewall when the shoe is bearing substantial weight. This means, however, that each ot the sidewalls of the shoe must be larger in dimension than is really necessary.

Further, in pin-and-slot couplings in the past of ladder shoes to ladder rails, the arrangement was such that, although the shoe when in toe-down position was locked in that position so long as weight from the ladder was on the shoe, the shoe did not remain so locked if momentarily relieved of such weight as, say, by a lifting of the ladder by a slight amount in order to make a small adjustment in its position. Thus, it was often necessary after such an adjustment to reset the shoe to toe-down position, and to have to do so was, of course, an inconvenience.

SUMMARY OF THE INVENTION

One or more of the disadvantages outlined above are obviated by a ladder foot according to the present invention and comprising bracket means attachable at its upper end to a ladder rail and including a downwardly extending longitudinal strut or stud and stop means disposed at the upper end of the stud, a shoe including a central lateral soleplate (disposed outward of the stud) and a pair of upper plates extending from laterally opposite sides of the sole plate towards the bracket means to straddle opposite sides thereof, and, further, a pin fixedly secured with such upper plates and passing laterally from one the other thereof through the bracket means adjacent the front side of the stud to be moveable longitudinally thereto over upper and lower ranges of the stud. The pin, when at the top of such upper range, is adapted to bear against the said stop means so as to transmit therefrom to the shoe a part of the weight force of the ladder and its occupant. For other positions of the pin in such upper range, the design of the stud is such as to lock the shoe in toe-down position despite relative movement occurring between the shoe and the bracket means. When, however, the pin has been displaced to be in the lower range, the design of the stud in such range permits the shoe to be angularly adjusted from its toe-down position to its flat position or intermediate positions.

BRIEF DESCRIPTION OR THE DRAWINGS

For a better understanding of the invention, reference is made to the following description of an exemplary embodiment thereof and to the accompanying drawings wherein.

STRUCTURE OF EMBODIMENT

Figure 1:
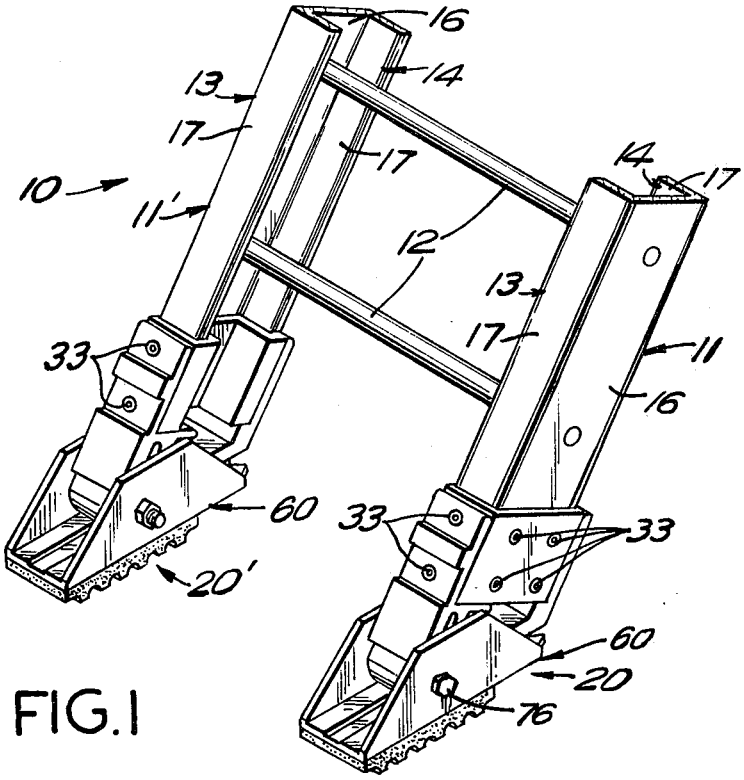
FIG. 1 is an isometric view of the lower portion of a ladder equipped with two ladder feet each according to the invention.

Referring to FIG. 1, the reference numeral 10 designates a ladder of which only the lower portion is shown, and which comprises a longitudinal rails 11, 11' and lateral rungs 12, the rails 11, 11' being made of fiberglass and having each a front side 14 and a back side 13 separated by the transverse dimension of the rail. The right-hand and the left-hand rails 11 and 11' are respectively equipped with right and left-hand ladder feet 20 and 20' which are duplicates, and of which only the right-hand foot 20 will be described in further detail.

Figure 2:
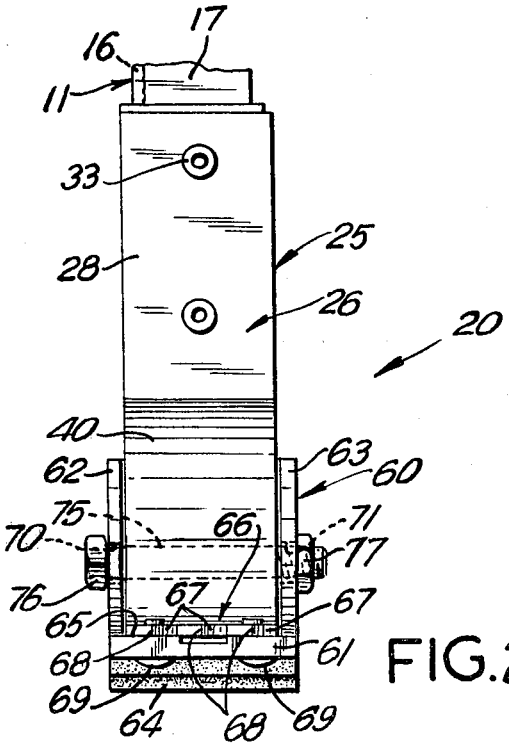
FIG. 2 is a rear elevation of the left-hand ladder foot shown in FIG. 1.
Figure 3:
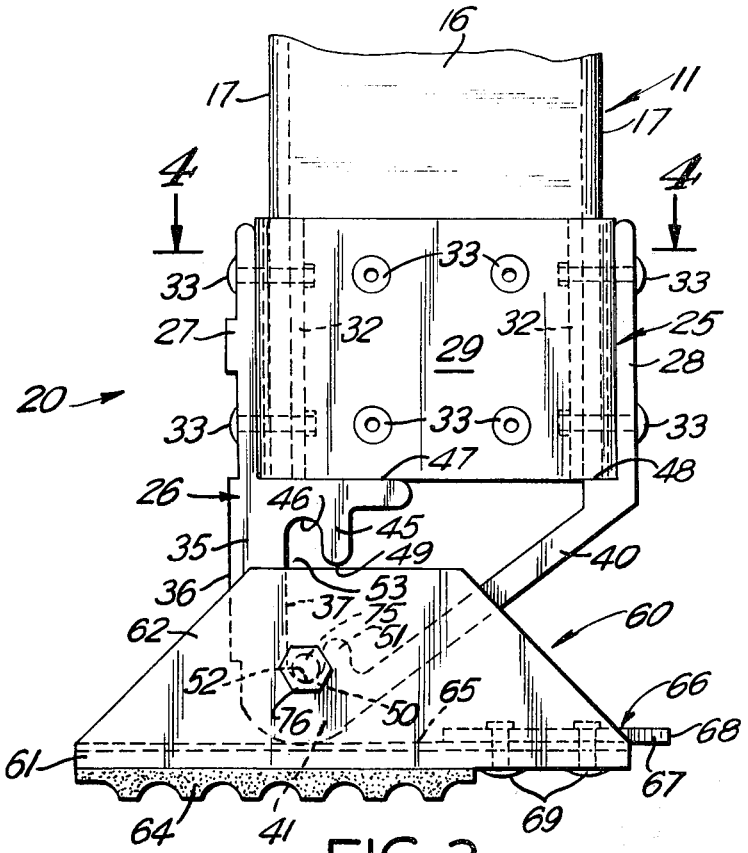
FIG. 3 is a right-side elevation of the FIG. 2 foot with the shoe of that foot being in flat position.
Figure 4:
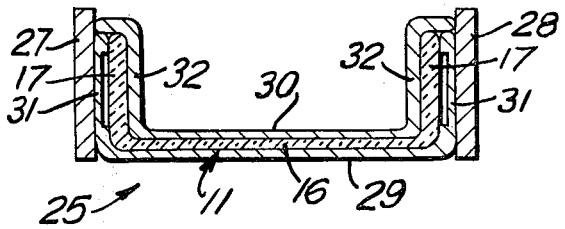
FIG. 4 is a plan view, taken as indicated by the arrows 4—4 in FIG. 3 of a cross section of the bracket means of the FIG. 2 foot and of a portion of a rail to which such a bracket means is attached.

As best shown in FIGS. 2, 3 and 4, the foot 20 comprises a bracket means 25 of which a principal component is a single-piece V-shaped leg 26 providing at its upper end (as integral parts thereof) a back plate 27 and a front plate 28, the two plates lying in respective transversely-spaced lateral-longitudinal planes. When the foot 20 is in use with ladder 10, the plates 27 and 28 contain between them the bottom of rail 11 which (as best shown in FIG. 4) is, in lateral cross section, in the form of a channel of U-shape so as to have a central longitudinally elongated web 16 and, also, a pair of side flanges 17 projecting out in the same direction from the transversely opposite sides of web 16 towards the center line of ladder 10. The bottom of such channel shaped rail is laterally sandwiched between outer and inner cross plates 29 and 30 which form parts of the bracket means 25 and which correspond in configuration to and mate with the U-shaped cross sectional configuration of rail 11 such that the side flanges 31 of the cross plate 29 are disposed between the plates 27, 28 and the side flanges 17 of the rail, and such that the side flanges 32 of cross plate 30 are disposed transversely inwards of such flanges 31 and 17. The bracket means 25 is attachable in use to the bottom of rail 11 by rivets 33 or the equivalent thereof (FIG. 3) which pass as shown through the plates 27–30 and through the rail 11 to join those plates with each other and with the rail bottom.

The leg 26 of bracket means 25 includes (as another integral part thereof) a strut or stud 35 forming a continuation of the back plate 27 so as to extend downward from the upper end of the bracket means at the back thereof. Strut 35 has front and back sides 36 and 37 which are separated in the transverse dimension at its bottom, and strut 35 is integrally joined with a diagonal brace 40 which also forms an integral part of leg 26, and which extends from the lower end of strut 35 longitudinally upward and transversely outward to make an integral juncture at its upper end with the bottom of the front plate 28. The leg 26 is rounded on its bottom surface at the juncture region of elements 35 and 40 so as to form a rounded bearing heel 41 for the bracket means 25.

The leg 26 further includes (as an integral part thereof) upper stop means in the form of an upper stop nib 45 projecting frontwardly out from the upper part of strut 35. The underside of nib 45 is shaped to have formed therein a laterally extending notch 46 with a downwardly facing curved inner wall surface which merges smoothly at its left-hand side with the front side 37 of the strut 35. Notch 46 is bounded at its right-hand side by a downwardly-projecting lateral lip or detent 49 forming part of the upper stop nib. The upper side of such nib is shaped to provide an upwardly-facing planar shoulder 47 adapted in use to be contacted by the bottom surface of rail 11 so as to bear the weight force on that rail and thereby relieve rivets 33 of the load imposed by that weight force. A similar smaller shoulder 48 is provided for the same purpose at the juncture region of brace 40 and front plate 28.

Towards its lower end, leg 26 is shaped to provide (as an integral part thereof) lower stop means in the form of a lower stop nib 50 projecting frontwardly out from the front surface 37 of strut 35. Nib 50 includes a laterally extending upwardly projecting lip or detent 51 transversely spaced from such front surface 37 so as to provide between that lip and that surface a lateral notch 52 the interior wall surface of which merges smoothly on its left hand side with that surface 37. Stud 35 and upper and lower nibs 45 and 50 can be considered to define a partial slot 53 which is bounded around part of its perimeter by the front side 37 of the stud and the inner wall surface of notches 46 and 52, but which has a gap in its perimeter between the projections 49 and 51 of the two nibs.

Associated with bracket means 25 is a shoe 60 comprising a laterally lying sole plate 61 disposed outward of the bracket means and, also, a pair of upper plates 62 and 63 projecting from laterally opposite sides of the sole plate towards the bracket means to straddle laterally opposite sides thereof. The underside of sole plate 61 has attached thereto, by adhesive bonding, screws (not shown) or other suitable means, an skid resistant pad 64. The inner surface 65 of the sole plate has attached thereto, at its front end and by rivets 69, a spur 66 salient from the toe of shoe 60 and having at its front teeth 67 of triangular shape in the plane of the spur so as to terminate in respective sharp points 68.

The upper plates 62 and 63 of shoe 60 have respectively formed therein a pair of laterally aligned cylindrical holes 70 and 71 within which are received with a reasonably close fit the opposite ends of a cylindrical pin 75 which may conveniently take the form of a bolt having a head 76 on the outside of plate 63 and having, also, a nut 77 thereon on the outside of plate 62. By virtue of the fit between holes 70, 71 and the pin 75, the pin is fixedly secured to upper plates 62, 63 in the sense that, except for the clearance, if any, between the pin and those holes, the pin is translationally fixed in relation to those plates in the longitudinal and transverse dimensions. Pin 75 may, if desired, have some lateral play within holes 70, 71 and, moreover, be rotatable therein, but no useful purpose would be served thereby. Any lateral play and rotatability may be eliminated by appropriate tightening of the nut 77. As shown, the pin 75 passes laterally from one to the other of upper plates 62 and 63 through the bracket means 25 adjacent to the front surface 37 of the stud 35.

Returning to a consideration of the bracket means, it will be noted that its shown one-piece leg 26 extends continuously in the lateral direction from one side to the other of the bracket means so as to use the full lateral extent thereof for cooperation with the pin. Alternatively, the single leg 26 can be replaced by two laterally spaced legs of the same transverse and longitudinal configuration as the shown one-piece leg 26. As another alternative, whether the bracket means employs a one-piece leg as shown or the mentioned two legs, the leg or legs can be modified in form by filling with leg material all of the void included between the left and right hand portions of the leg or legs and the rail supporting shoulders thereof except for a portion left void to provide a vertical slot (for one leg) or slots (for two legs) permitting longitudinal movement of the pin 75 relative to the bracket means. In such case, the described stud and stop nibs would become regions of such monolithic leg or legs rather being individually demarcated parts of the bracket means.

OPERATION AND USE

Figure 5:
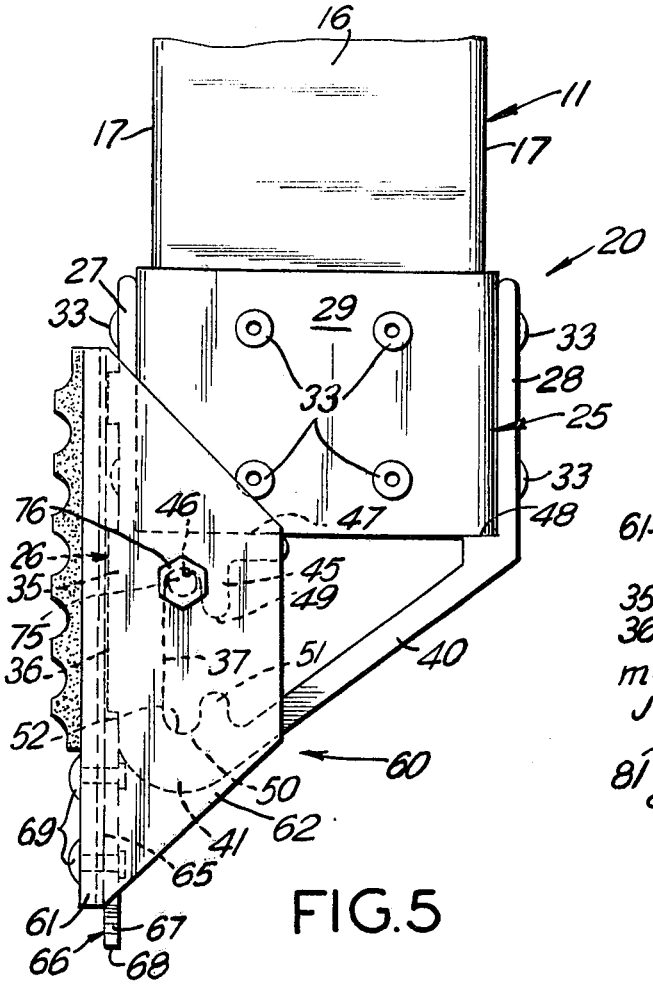
FIG. 5 is a right-side elevation of the FIG. 2 foot with the shoe thereof being in toe-down position.
Figure 6:
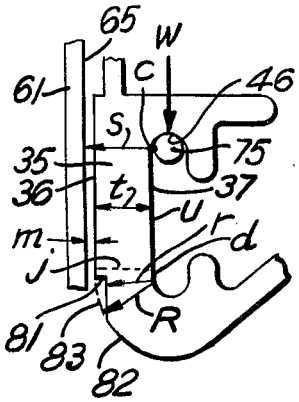
FIGS. 6–8 are diagrammatic views illustrative of the mode of operation and use of the FIG. 2 foot.
Figure 7:
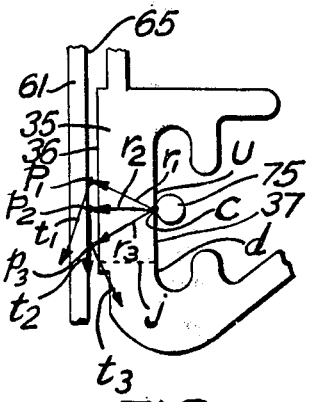
Figure 8:
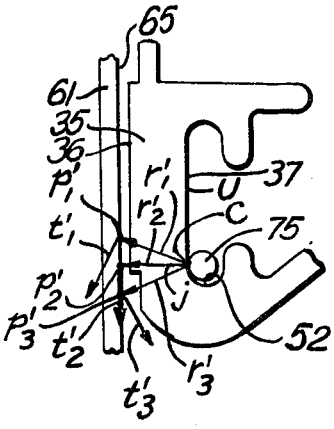

The operation and use of the described ladder foot 20 is best understood from a consideration of FIGS. 3 and 5 and of the diagrams provided by FIGS. 6–8. Referring first to FIG. 6, the stud 35 has an upper range u which terminates at its top at the notch 46. Over the range u, the back and front sides 36 and 37 of the stud are longitudinal or substantially so, and the transverse thickness of the stud which separates those two sides remains substantially the same over that range.

The pin 75 is shown in FIG. 6 as being received in notch 46 to bear transversely at the top of range u against the front side 37 of the stud to make line contact with that front side at the contact point c on the exterior of the bolt. For that position of the pin in relation to the stud, the shoe 60 is in toe-down position such that its sole plate 61 is substantially parallel to the opposing portion of the back side 36 of the stud. The separation s between the contact point c on pin 75 and the inner surface 65 of sole plate 61 is such that, over its upper range u, the stud 35 fits with a clearance of approximately m between the pin and the sole plate. Some such clearance is desirable to facilitate unchecked longitudinal movement over the range u of the pin and shoe relative to the stud. Moreover, some such clearance is also desirable to better assure that such longitudinal movement can be obtained in instances of practical use where dirt, ice or other extraneous material has worked into the mechanism of the foot 20.

With the relative positioning of elements represented in FIGS. 5 and 6, the bracket means is adapted to transmit through its stop nib 45 to the pin 75 a force W directed primarily downward on the pin and primarily corresponding to the weight of the ladder 10 and its occupant which is distributed to the rail 11. Because pin 75 makes contact with the curved interior wall surface of notch 46 formed in nib 45 rather than with a low friction planar surface, the active force W on the pin is opposed by a reactive force therefrom which is substantially in line with W and which, accordingly, does not create any substantial force component directed transverse to W and requiring compensation to offset the effect thereof.

The weight force W is transmitted from pin 75 through upper plates 62 and 63, sole plate 61 and spur 66 to the footing for the ladder. In the course of such transmission, the transverse displacement between sole plate 61 and pin 75 creates a moment producing in the shoe 60 a small angular tilt which is not shown in FIGS. 5 and 6, but which will cause the upper end of sole plate 61 to bear against the upper back side of bracket means 25. If the force W is removed while pin 75 remains in notch 46, the shoe 60 will, nonetheless, remain locked in toe-down position in the sense that the proximity of the inner surface 65 of sole plate 61 to the back side 36 of step 35 prevents any angular movement therebetween except for such small angular play as may be permitted by the clearance m.

By virtue of the fact, that, over the upper range u of stud 35, its back and front sides are substantially longitudinal and are separated by a stud thickness remaining substantially the same over that range, the pin 75 is adapted to move relative to stud 35 over range u in such manner as to produce relative movement between the bracket means 25 and the shoe 60 which is substantially wholly longitudinal, i.e., which is substantially wholly in the direction of lie of rail 11 and has no substantial component of movement transverse to that direction.

The FIG. 7 diagram is representative of instances where the pin 75 has moved down from its FIG. 6 position to an intermediate position in range u as a result, for example, of the ladder 10 being lifted slightly in the course of making a small adjustment in its leaning position. With the pin 75 being in its FIG. 7 position and making contact by point c thereon with the front side 37 of stud 35, the point c acts as a pivot point for angular movement of the shoe 61 relative to stud 35. If there were to be such movement counterclockwise, the various shown points $p_1$, $P_2$, $p_3$ on the inner surface 65 of shoe 61 which are spaced from point c by the respective radial distances $r_1$, $r_2$, $r_3$ will undergo respective incremental tangential movements normal to such radial distances and depicted, respectively, for those points by the arrows $t_1$, $t_2$, $t_3$. The tangential movement of point $p_3$ will, however, be directed as shown towards the back side of the stud so that such movement will be almost immediately arrested by the coming into contact below point c of the sole plate 61 with the stud 35. Accordingly, it will be apparent that so long as the pin 75 remains in range u the shoe 60 will remain locked in toe-down position in the sense that its angular movement relative to bracket means 25 is restricted to at most a small amount of angular play.

To state it another way, shoe 60 will remain so locked in toe-down position as long as the radial distance r from the contact point c (FIG. 6) on the stud's front side 37 to any point below point c on the stud's back side 36 is greater than the separation s between the pin 75 and the sole plate 61.

In order to permit the shoe to be unlocked from that position, the stud 35 has a lower range d over which the value of the radial distance r from any point in range d on the stud's front side to any points in that range on the stud's back side does not exceed (while possibly being lesser by any selected and appropriate amount than) a limiting value R which will permit free angular adjustment of the stud between toe-down and flat positions. In theory, such limiting value R is the same as the value of the mentioned separation s between pin 75 and the inner surface 65 of sole plate 61. For practical purposes, however, such limiting value R should be somewhat less than s (in order to provide clearance between stud 35 and shoe plate 61 in the course of such adjustment) and, conveniently, is an approximation of the mentioned transverse thickness t of the stud in its upper range u in the sense that the value of R can be equal to or somewhat more or less than the value of t, but in any event is less than the value of s. In FIG. 6, the dotted line 83 represents generally the boundary which the back side 36 of stud 35 must stay within in range d in order to satisfy that criterion. As shown in that figure, the mentioned radial distance r may be caused to at most approximate t by providing near the top of range d a slight frontward offset 81 of the stud's back side 36 and further, by imparting to such back side below offset 81 a curvature 82 of such character that, as such side extends downward from offset 81, it is transversely displaced therefrom progressively more frontwardly. Of course however, other configurations may be selected for stud 35 in its lower range d which will achieve the same result of having the mentioned radial distance r at most approximate t.

FIG. 8 illustrates how, with stud 35 being configured in its lower range d as described, shoe 60 can be angularly adjusted between its toe-down and flat positions when pin 75 is located in such lower range. For that circumstance, the shown points $p'_1$, $p'_2$ and $p'_3$ on the inner surface 65 of sole plate 61 are separated by respective radial distances $r'_1$, $r'_2$ and $r'_3$ from the contact point c of the pin with the stud's front side 37, and such points are adapted to undergo respective incremental tangential movements represented by the arrows $t'_1$, $t'_2$ and $t'_3$, respective thereto when the shoe 60 is angularly adjusted counter-clockwise about point c as a pivot. The incremental tangential movement of points $p'_1$ and $p'_2$ will be, respectively, away from and parallel with the stud's back side 36. On the other hand, the incremental tangential movement of point $p'_3$ will be towards the vertical plane defined by side 36 in the upper range u of the stud but, because such back side 36 is configured as described above in the lower range d, counter-clockwise angular movement of the shoe 60 will not cause the point $P'_3$ (or any other point on the inner surface 65 of sole plate 61) to bear against the back side of the stud. Accordingly, with pin 75 being positioned within lower range d, shoe 60 can be freely angularly adjusted from its toe-down position (FIG. 5) to its flat position (FIG. 3) and conversely, and, moreover, to any intermediate angular position. The lower end of range d is determined by stop nib 50 which arrests downward movement of pin 75 relative to stud 35.

The lower range d of the stud is shown in FIG. 6 as being contiguous with upper range u and as meeting it at the juncture line j. With those two ranges being so contiguous, the shoe in effect "turns a corner" when pin 75 is moved slightly from one side to the other of line j in that the condition of the shoe abruptly changes between fully locked and fully free as to the angular adjustability of the shoe between toe-down position and a position at which further movement of the front end of the shoe is stopped by contact being made by the shoe's spur 66 and brace 40. There can, of course, be between ranges u and d a transition range for which the positioning of the pin 75 therein will permit large angular play of the shoe relative to bracket means 25 while not permitting angular adjustment of the shoe beyond such play, but the providing of such transition range would serve no useful purpose. The lower range d is substantially smaller than upper range u, but has some longitudinal extent to permit the heel region 41 of the stud 35 to fit with clearance between the pin 75 and the inner surface 65 of sole plate 61.

With the pin 75 being in the lower range d and the shoe 60 being in its flat position normal to rail 11 (FIG. 3) or slightly tilted away from the normal to such rail, the heel 41 of bracket means 25 bears against the shoe 61 to transmit weight force from the ladder and its occupant directly to the shoe, and from the shoe, to the ladder footing. Once the shoe has been manipulated to bring pin 75 into that lower range, the pin tends to stay in that range unless the shoe is further deliberately manipulated to move it fully to toe-down position for purposes, say, of shifting the pin into the upper range. Conversely, while pin 75 is in the upper range u to render the shoe 60 locked in toe-down position, the shoe tends to stay in such position unless the shoe is deliberately manipulated to shift the pin down into the lower range and the pin is then deliberately angularly adjusted to move it away from its toe-down position towards its flat position. Thus, in the absence of unusual casual movement of the shoe, it is bistable as to its angular adjustability condition in the sense that, when pin 75 is in ranges u and d, respectively, the shoe 60 is in conditions as to such angular adjustability of, respectively, being substantially fully locked and being free to angularly move through a substantial range, the change between those two conditions being, as stated, abrupt.

When the pin is in the lower range, the shoe 60 is freely angularly moveable between the various angular positions relative to bracket means 25 which the shoe is required to assume in order to adjust to various angles of leaning of the ladder and various departures from the horizontal of the footing on which the shoe rests. At the same time, because pin 75 while in the lower range is received in the notch 52 formed in stop nib 50 so as to be contained on either transverse side within the interior wall surface of that notch, the shoe 60 will be constrained by contact between the pin and the sidewalls of that notch from moving translationally relative to bracket means 25 in the transverse direction except for the small amount of such movement permitted by clearance between such pin and such sidewalls.

DETAILS OF CONSTRUCTION

In the exemplary embodiment of the invention described above, the transverse width of the rail 11 is $3\frac{3}{4}$ inches, and the dimensions of the various parts of the ladder foot 20 are to scale in FIGS. 2–5 with that reference dimension. The various parts of the bracket means 25 are all constituted of aluminum with leg 26 being a single aluminum extrusion. Such fabrication of leg 66 out of a single such extrusion is made possible by the fact that leg 26 contains no slot which is closed all around. The shoe 60 is similarly constituted entirely of aluminum except that the pad 64 on the shoe is constituted of rubber or comparable material, and the spur 66 is constituted of steel. Bolt 75 and its nut 77 are made of steel.

The above described embodiment being exemplary only, it is to be understood that additions thereto, omissions therefrom and modifications thereof can be made without departing from the spirit of the invention, and that, accordingly, the invention is not to be considered as limited save as is consonant with the recitals of the following claims.

What is claimed is:

1. A foot for a ladder having longitudinal rails, lateral rungs and transversely separated front and back sides for said rails, said foot comprising:

(1) bracket means attachable at its upper end to the bottom of one such rail and having (a) a stud extending downward from said end at the back of said bracket means and having front and back sides separated by the transverse thickness of said stud, said stud (i) having an upper range over which its front and back sides are substantially longitudinal and said thickness remains substantially the same, and (ii) a lower range in which the radial distance from any point therein on such front side to any point therein on such back side at most approximates said thickness in said upper range, and said bracket means also having (b) upper stop means frontward of the front side of said stud at the top of its upper range;

(2) a shoe of U-shape in lateral cross section and including:

(a) a central lateral sole plate disposed outward of said bracket means, and (b) a pair of upper plates extending from said sole plate towards such bracket means to straddle laterally opposite sides thereof, and (3) a lateral pin fixedly secured at its opposite ends with said upper plates, such pin passing from one to the other of such plates through said bracket means adjacent said stud to be movable longitudinally relative thereto over such upper range, the separation between said pin and sole plate permitting the upper range of said stud to fit therebetween with a clearance facilitating such longitudinal movement; and (4) said pin pivotally coupling said shoe to said bracket means in a manner which (a) when said pin is in such lower range, permits angular adjustment of said shoe between flat and toe-down positions for which said sole plate is, respectively, transversely disposed in contact with the lower end of said bracket means and longitudinally disposed at the back side thereof, and (b) when said pin in said upper range, said shoe is locked in toe-down position, and (c) when said pin is at the top of said upper range, said upper stop means contacts said pin and is adapted to transmit longitudinal force thereto.

2. A ladder foot according to claim 1 in which said upper stop means forms at the top of said upper range of said strut a downward facing notch for receiving said pin, said notch having a curved inner wall surface adapted to transmit primarily downward force to said pin such that the reactive upward force therefrom is substantially in line with said downward force and is without a substantial force component normal to said downward force.

3. A ladder foot according to claim 1 in which said bracket means includes lower stop means disposed frontwardly of the front side of said strut at the bottom of said lower range thereof to arrest downward movement of said pin relative to said stud.

4. A ladder foot according to claim 3 in which said lower stop means has formed therein an upwardly facing notch disposed adjacent said front side of said stud and adapted, when said pin is in said lower range, for receiving said pin and constraining it against transverse translational movement relative to said stud.

5. A ladder foot according to claim 3 in which said upper and lower stop means are integral with said stud and form frontward of the front side of said stud a partial slot with a perimeter which is bounded part way round by such front side and such upper and lower stop means, but which perimeter has a gap therein between said two stop means on the side of such partial slot transversely away from said front side of such stud.

6. A ladder foot according to claim 1 in which said stud of said bracket means extends continuously from one to the other of the laterally opposite sides of said bracket means.

7. A ladder foot according to claim 1 in which said bracket means includes a diagonal brace extending from the lower end of said stud transversely frontward and longitudinally upward to be coupled at the top thereof with said upper end of said bracket means, and in which for said bracket means has at its lower end a heel adapted to bear on said sole plate.

8. A ladder foot according to claim 7 in which said bracket means includes parallel transversely spaced back and front plates and two cross plates, said back and front plates being joined at their bottoms to the tops of, respectively, said stud and said brace and being, moreover, adapted to contain therebetween the transverse dimension of the bottom of said rail, and said two cross plates being adapted to transversely fit between said back and front plates and to be secured both thereto and to the bottom of said rail so as to attach said bracket means to such bottom.

9. A ladder foot according to claim 1 in which said shoe includes a skid resistant pad on the outer surface of said sole plate.

10. A ladder foot according to claim 1 in which said shoe includes a toothed spur coupled to said sole plate and projecting outward from the front end thereof so that such spur is presented downward when said shoe is in toe-down position.

11. A foot for a ladder having longitudinal rails, lateral rungs and transversely separated front and back sides for said rails, said foot comprising:

(1) bracket means attachable at its upper end to the bottom of one such rail and having a V-shaped leg extending downward from said upper end to provide a heel at the lower end of such means, said leg having a back segment which includes as integral parts thereof:

(a) a longitudinally elongated downwardly extending stud forming disposed between said upper end and said heel, and (b) upper and lower stop nibs projecting frontward from, respectively, upper and lower portions of said stud and having upper and lower, downwardly and upwardly facing, notches which are formed in, respectively, said upper and lower nibs so as to each be adjacent to the front side of said stud, said stud and said two stop nibs being definitive of a partial slot bounded over part of its perimeter by said stud's front side and said notches, and having between said two stop nibs a gap in its perimeter on the side thereof away from such front side;

(2) a shoe of U-shape in lateral cross section and including:

(a) a central lateral sole plate disposed outward of said bracket means, and (b) a pair of upper plates extending from said sole plate towards such bracket means to straddle laterally opposite sides thereof, and (3) a lateral pin fixedly secured at its opposite ends with said upper plates, such pin passing from one to the other of such plates through said bracket means adjacent said stud to be movable longitudinally relative thereto, the separation between said pin and sole plate permitting said stud to fit therebetween with a clearance facilitating such longitudinaly movement; and (4) said pin pivotally coupling said shoe to said bracket means.

* * * * *